United States Patent [19]

Haushalter et al.

[11] 4,376,619

[45] Mar. 15, 1983

[54] ACCUMULATOR-RESERVOIR DEVICE DIAPHRAGM CONTROL

[75] Inventors: Frederick W. Haushalter, Kenton; Thomas J. Lord, Dayton, both of Ohio

[73] Assignee: United Aircraft Products, Inc., Dayton, Ohio

[21] Appl. No.: 915,144

[22] Filed: Jun. 14, 1978

Related U.S. Application Data

[63] Continuation of Ser. No. 742,419, Nov. 17, 1976, abandoned.

[51] Int. Cl.[3] ..... F04B 11/00

[52] U.S. Cl. ..... 417/540; 92/98 D; 92/94; 138/31; 165/104.31

[58] Field of Search ..... 74/182; 92/98 D, 94; 417/540; 138/31; 237/66; 165/107 D

[56] References Cited

U.S. PATENT DOCUMENTS

| | | | |
|---|---|---|---|
| 2,973,644 | 3/1961 | Greenawalt | 92/94 X |
| 3,559,727 | 2/1971 | Hill et al. | 138/31 X |
| 3,677,334 | 7/1972 | Bathla et al. | 138/31 X |

*Primary Examiner*—Richard E. Gluck
*Attorney, Agent, or Firm*—J. E. Beringer

[57] ABSTRACT

A fluid circulating system including a pump and an accumulator-reservoir device of the bootstrap type in which operation of the pump energizes the device to maintain a pressurized system despite an increasing fluid density caused by lowering fluid temperatures. A light spring force is applied which establishes a minimal system pressure effective even when the pump is shut off and which maintains in its proper convolution a rolling diaphragm comprised in the accumulator-reservoir device.

6 Claims, 5 Drawing Figures

FIG-1
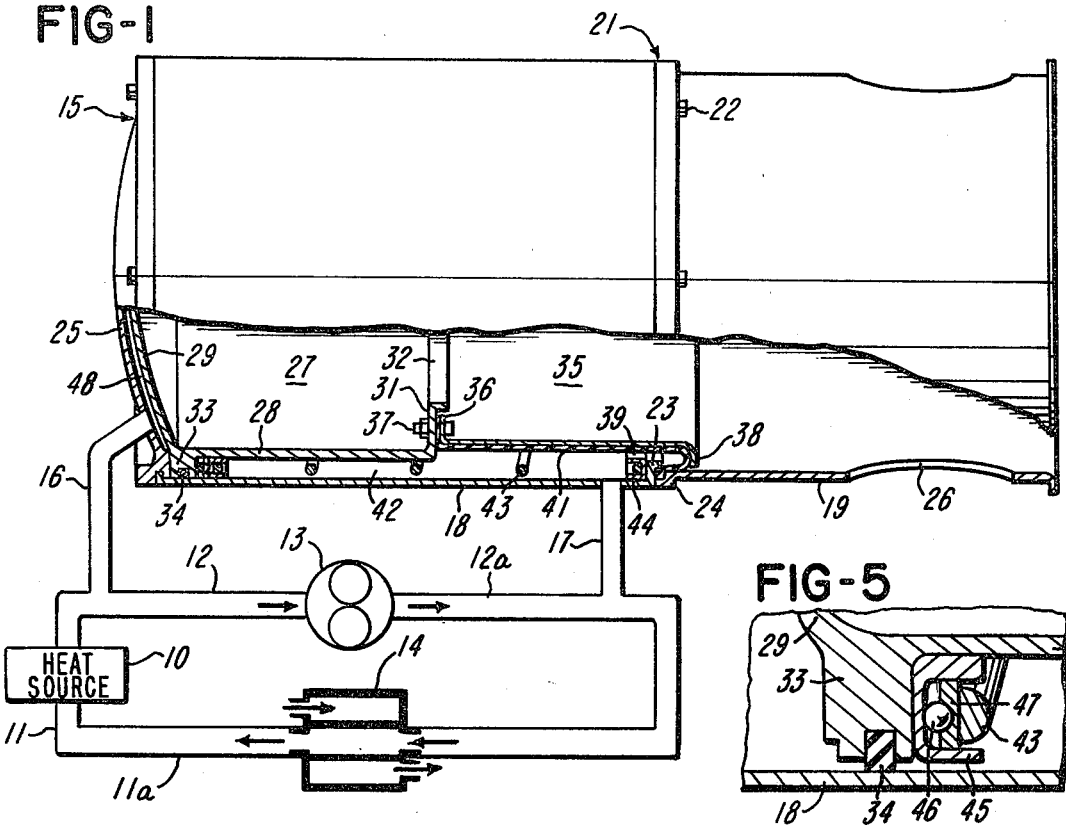
FIG-5
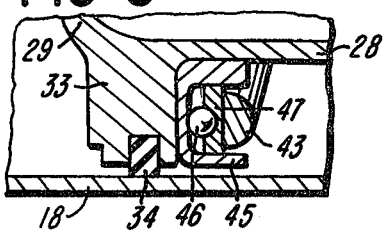
FIG-2
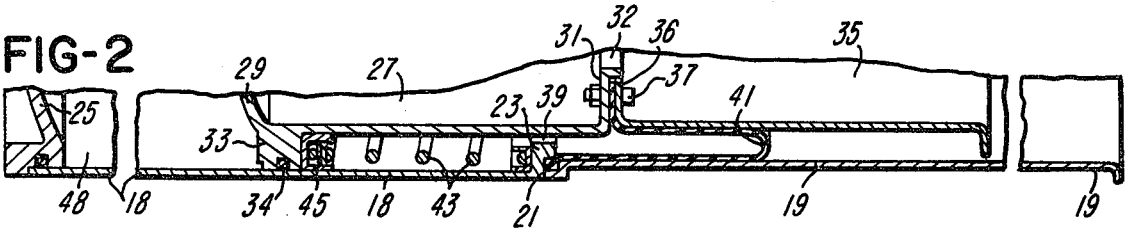
FIG-3
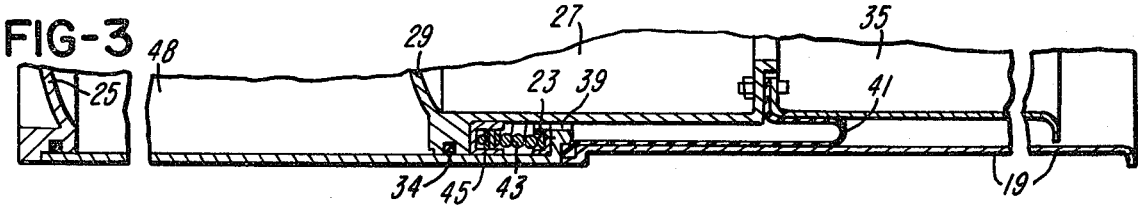
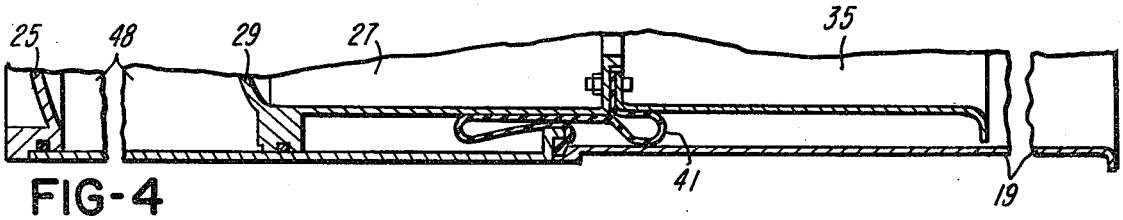
FIG-4
(PRIOR ART)

ACCUMULATOR-RESERVOIR DEVICE DIAPHRAGM CONTROL

This is a continuation of application Ser. No. 742,419, filed Nov. 17, 1976, now abandoned.

BACKGROUND OF THE INVENTION

This invention relates to fluid circulating systems as they include an accumulator-reservoir device of the bootstrap type. More particularly, the invention is concerned with devices as identified incorporating a flexible, rolling diaphragm which changes convolution in response to movements of a reciprocable fluid pressure operated piston.

In prior art systems, the accumulator-reservoir device accommodates fluid expansion due to temperature increases by a yielding motion of the piston in one sense. Decreasing temperatures, which bring about a greater fluid density, are compensated for by a pressured movement of the piston in the opposite sense, this being a function of operation of the pump which has a connection at its outlet side to the accumulator-reservoir device. While the pump operates, the fluid pressure it applies is effective yieldingly to bias the piston in the accumulator-reservoir device and is applied also in a manner to maintain the rolling diaphragm in a convolution appropriate to the position assumed by the piston. A normal operating condition of the system finds the piston displaced a distance against the effects of pump pressure since the fluid is at this time warm and relatively expanded. If the pump now is shut off, the system cools and fluid density is reduced. The pressure of ambient surroundings is available to move the piston in the accumulator-reservoir device to obviate a creation of sub-ambient fluid pressures in the device. In some instances, however, friction effects sufficiently retard piston movement that the rolling diaphragm, also subject to the pressure of ambient surroundings, moves relatively to the piston and assumes an inverted attitude between the piston and an enclosing housing out of a proper convolution. Now, when the pump is again turned on, a pressured movement of the diaphragm to its correct position is attempted with what is sometimes damaging effect upon the diaphragm.

Temperature changes, referred to in the foregoing, occur as a result of changing ambient temperatures and as a result of placing the system in operation and of discontinuing such operation.

SUMMARY OF THE INVENTION

The instant invention has in view an improvement in systems of the prior art in which a means independent of the pump and operating through the accumulator-reservoir device maintains at least a minimal fluid pressure in the system while the pump is not operating. The maintained fluid pressure is adequate to overcome friction effects in the device, and problems related to a displaced diaphragm do not arise. In accordance with the illustrated embodiment of the invention, the provided independent means is a relatively light spring installed in the accumulator-reservoir device to exert a continuing pressure on the piston therein, in the same direction in which the piston is urged by pump pressure when the pump is on. Accumulator-reservoir devices are known in which a diaphragm is continuously biased in one direction by a spring or by pressure fluid means but these are not devices of the bootstrap type and are without pertinence to the present invention, in our opinion.

An object of the invention is to provide an improved fluid circulating system, and particularly an improved accumulator-reservoir device in such a system, substantially as has been indicated above.

Other objects and structural details of the invention will appear from the following description, when read in connection with the accompanying drawings, wherein:

FIG. 1 is a view in partly diagrammatic form, showing a fluid circulating system in accordance with the illustrated embodiment of the invention, the system being shown empty or substantially empty of fluid;

FIG. 2 is a fragmentary view of an accumulator-reservoir device as shown in FIG. 1, the parts being shown as they may appear in a normal operating condition of the system;

FIG. 3 is a view similar to FIG. 2, showing the parts as they appear in an operation at a maximum expected temperature;

FIG. 4 is a view like FIGS. 2 and 3, showing an accumulator-reservoir device according to the prior art; and FIG. 5 is a fragmentary enlarged view of a portion of the accumulator-reservoir device.

Referring to the drawings, the illustrated system circulates liquid coolant for cooling purposes, as for example to cool electronic equipment in aircraft. The system circulates an appropriate liquid coolant through the electronic equipment or other heat producing source, where it absorbs generated heat. From the heat source, the coolant is directed to the cooling system where heat is rejected in a suitable heat transfer device to air, other liquid or to some other medium acting as a heat sink. The coolant is then returned to the heat source where it absorbs additional heat and is again returned for cooling, the process involving a closed flow circuit in which the pump, while operating, maintains continuous pressure on and continuous circulation of the flowing coolant.

As indicated in the diagrammatic illustration of FIG. 1, liquid coolant is directed to a heat source 10 by way of a conduit 11 and returns therefrom by way of a conduit 12. The latter extends to the suction or inlet side of a pump 13, the pressure or outlet side of which is connected by a conduit extension 12*a* to one side of a heat exchanger 14. Within a heat exchanger 14, the coolant is brought into heat transfer relation to another, relatively cooler fluid and is continuously directed through and beyond the heat exchanger by conduit means 11*a* leading to and forming a part of conduit 11. The flowing system may include other components, as for example a valve controlled bypass around the heat exchanger 14.

An accumulator-reservoir device 15 is placed in communication with the fluid flowing system by way of conduits 16 and 17 connecting in the system respectively at inlet and outlet sides of the pump 13. The device 15 provides interior space to accommodate expansion of the coolant when increasing fluid temperature brings about a decreasing density thereof. Also, pressure applying means within the accumulator device maintains pressure in the system. An increasing density of the coolant thus will not allow the pump suction pressure to fall below the desired value, since whatever loss of pressure occurs is compensated for by movement of the pressure applying means. The attainment of pressure values within the accumulator-reservoir device higher than a selected predetermined value may be obviated by the provision of pressure relief means (not shown).

In accordance with concepts of the present invention, the accumulator-reservoir device 15 is a device of the bootstrap type, that is, one in which the energizing pressure for operation of the device has its sources in the pump 13. Considering the device in its illustrated form, it includes cylindrical housing sections 18 and 19 which as placed in end abutting relation define a joint 21. Screws 22 installed in abutting flanges 23 and 24 of the housing sections hold the sections in an assembled relation. At what may be regarded as an outer end thereof, housing section 18 has fixed thereto an end closure plate 25. Toward the outer end of housing section 19, redial apertures 26 appear therein. The housing according to the illustrated embodiment accordingly is generally cylindrical in form, is closed at one end and at its opposite end is open to ambient surroundings.

Within the defined housing is a reciprocable piston 27. A tubular body 28 thereof is in a concentric spaced relation to an interior wall of housing section 18. A dome-like head 29 closes one end of the body 28. An internal flange 31 at the other end defines a through opening 32. On the body 28, at or adjacent to head 29, is an external flange 33 in approximate bearing relation to the interior wall of housing section 28. In a groove in the periphery of flange 33 is a sealing member 34 making a direct sliding contact with the housing wall. A piston guide 35 is a tubular, open ended member acting as an extension of piston 27. At one end thereof an inturned flange 36 is clamped to inturned piston flange 31 by bolt means 37. An opposite end of the guide member has an outwardly flaring portion 38 approaching a bearing relation to an interior wall of housing section 19. Between its flanged and flared extremities, the guide member is in a spaced concentric relation to the housing wall.

The flange 23 at joint 21 constitutes an interior radial projection in the housing. In projecting radially inwardly, it approaches but does not contact the body 28 of piston 27, nor the corresponding body portion of guide member 35, leaving therebetween a clearance 39. The joint 21 receives and clamps the beaded outer periphery of an annular diaphragm 41. An inner periphery of the diaphragm positions between inturned flanges 31 and 36 and is clamped therebetween by bolt means 37. The diaphragm 41 is relatively wide between its inner and outer peripheries and forms itself in a convoluted shape to lie along the surface of guide member 35 and the interior wall of housing section 19. Freedom of longitudinal motion of the piston 27 is permitted, while sealing an interior housing space between the diaphragm and the flange 33. Clearance 39 provides freedom of movement of the diaphragm at joint 21.

The inwardly projecting flange 23 is in a generally opposing relation to piston flange 33 and defines therewith a chamber 42 which surrounds the piston 27 and its guide member 35. Arranged in the chamber 42 is a coil spring 43 which at its one end is based on flange 23 and at its other end bears upon flange 33 of the piston. More particularly, a base end of the spring 43 is received in a ring-shaped guide 44 seated to the flange 23 while an opposite end of the spring extends into a ring-shaped guide 45 seated to flange 33. In the guide 45 is a series of rolling bearings 46 and a friction plate 47, the latter being directly contacted by the spring 43. The arrangement, as will be evident, is one to allow the spring 43 to be axially compressed and to expand therefrom without being dislodged from a seat on flange 23 and without being affected by such relative rotary motion of the piston 27 as may occur. The spring 43 is a relatively light weight device having widely spaced convolutions. It imposes a relatively low level of resistance to movement of the piston 27 in one direction and provides a force for return of the piston in the opposite direction which is not significant in an operational mode of the system but which is adequate to its intended purpose in a non-operating mode. In describing the spring 43 as being without significance in an operational mode of the system, it will be understood that what is meant is that while the pump is operating, and developing fluid pressures in the system, the spring is incapable of and does not significantly affect positioning movements of the piston 27. Its force is not of significant value as compared to fluid pressures generated in operation of the pump.

Between its head portion 29 and end closure 25, the piston defines in the housing a closed chamber 48. Fluid flow conduit 16 projects through end closure 25 to communicate with chamber 48. Fluid flow conduit 17 projects through housing section 18 to communicate with annular chamber 42.

The parts are shown in FIG. 1 in the position they assume with the pump 13 stopped and with the system empty or substantially empty of fluid. Piston 27 is at this time under the influence of ambient pressure admitted through apertures 26 and under the influence of spring 43 and accordingly occupies a piston substantially as indicated, with flange 33 abutting end closure 25. In a manner which it is unnecessary here to consider, a fluid coolant is introduced into the system. This introduction is accomplished under pressure and is accompanied by a deflecting motion of piston 27 out of its FIG. 1 position, expanding chamber 48 so that it may accept fluid in excess of that actually required to flood heat source 10, pump 13, heat exchanger 14 and intercommunicating conduits. Appropriate temperature compensated indicator means may be provided to insure that the system is charged an amount which will not allow overexpansion of the fluid at temperatures of an expected high value and will not exhaust chamber 48 at temperatures of an expected low value. Thus, at an expected high temperature value, deflection of the piston 27 would be on the order of that illustrated in FIG. 3 while at an expected low value the position of the piston would be one in an approaching relation but short of contact with the head 25. Between these extremes piston 27 occupies an infinitely variable number of positions in accordance with fluid temperature. While the pressure of ambient surroundings and the pressure of spring 43 are applied in opposition to deflecting movement of the piston 27 the means more particularly concerned with resisting deflection of the piston and thereby with applying pressure to the fluid in chamber 48, is fluid pressure in chamber 42 admitted thereto by way of fluid conduit 17. Thus, in operation of the system, pump 13 circulates the fluid coolant by way of conduit 12*a* to and through heat exchanger 14. The temperature of the flowing coolant is reduced in heat exchanger 14 and the fluid continues on therefrom by way of conduit 11*a* and 11 to the heat source 10 where it absorbs heat from heat producing components and then continues its flow by way of conduit 12 back to pump 13. The fluid in chamber 48 is under pressure by reason of the continuing pressure exerted thereon by piston 27, such continuing pressure being in turn a function of the communication of annular chamber 42 with the pressure or outlet side of pump 13. Thus, fluid admitted to chamber 42 reacts on flange 23 and presses against flange 33 in a direction to urge the piston toward end closure 25. As the overall temperature of the fluid in the system rises, due either to ambient temperature increase or to heat generated in operation of the system, or to both, an accommodation must be provided for fluid expansion. In this system this is accomplished by a deflecting movement of the piston 27 away from end closure 25 or to the right as viewed in FIG. 1. This increases the volume of chamber 48, and such deflecting motion is continued until the system reaches what may be regarded as a normal operating temperature. At this time, the parts assume a position substantially as shown in FIG. 2. The fluid pressure applied in chamber 42 is a biasing or yielding pressure and allows deflection of the piston under the forces of expanding fluid system pressure. In the event of a decreasing fluid temperature, due either to ambient temperature decrease or to a discontinuing of the operation of the system, or to both, fluid density increases and the volume requirements of the system become less. Under these circumstances, the fluid pressure in chamber 42 is effective on flange 33 to move the piston 27 leftward or toward end closure 25, reducing the volume of chamber 48. The result is to maintain pressure on the fluid in the system despite a growing fluid density and to maintain the suction or inlet side of the pump 13 flooded with fluid for circulation in the system.

As may be seen, pressure in chamber 42 acts upon the diaphragm 41 in a manner to maintain it in a proper convolution and in contact respectively with the piston guide member 35 and the interior wall of housing section 19. As the piston reciprocates, the diaphragm has a smoothly flexing, rolling motion in moving between extreme positions as shown in FIGS. 1 and 3 without altering its basic convolution.

Assuming the parts to be in a normal operating position, substantially as shown in FIG. 2, and assuming pump 13 to be then shut off, the immediate effect is to depressurize the system. However, the position of the parts does not appreciably change until the fluid temperature begins to drop. At this point, the fluid occupied volume of chamber 48 becomes less. In compensation therefore, the piston 27 moves leftward to reduce the physical volume of chamber 48, this motion being in the main a function of the exposure of the back side of the piston to the pressure of ambient surroundings. To allow this compensating motion of the piston 27, it is necessary that there be available a force adequate to overcome the friction of contact of the sealing member 34 with the interior wall of housing section 18. In some instances the pressure of ambient surroundings may be inadequate to this purpose. In the prior art, in the presence of excessive friction at sealing member 34, ambient pressure was free to flow around flare 38 on guide member 35 and apply itself to a longitudinal displacement of diaphragm 41 through clearance 39. It will be understood in this connection that the fluid occupied volume of chamber 42 has decreased along with a decrease in the fluid occupied volume of chamber 48. Accordingly, the diaphragm 41 is allowed to be displaced through clearance 39 into chamber 42 where it may occupy an improper, inverted convolution. FIG. 4 hereof illustrates the described condition of the prior art in which a shutting down of pump 13 followed by a cooling of the fluid and a resistance to movement of the piston has resulted in the diaphragm being inverted and displaced into chamber 42. As will be evident, if the pump 13 is restarted with diaphragm 42 in an inverted position as shown in FIG. 4 fluid pressure admitted to chamber 42 will be applied in a manner to force the diaphragm back through clearance 39 and into a proper convolution. In doing so, however, the diaphragm is placed in frictional contact with flange 23 and other housing parts and in subject to abrading, tearing influences. It has been determined that this is a significant cause of diaphragm failure.

In providing a spring 43 in accordance with the present invention, a cause of diaphragm damage in accumulator-reservoir devices of the bootstrap type is avoided. Thus, in a device equipped as shown in FIGS. 1 through 3 hereof, in the event of frictional resistance at the flange 33 greater than can readily be overcome by ambient pressure, the spring 43 comes into play and forcibly moves the piston 27 in a direction to maintain a pressure in the system. In this connection, it will be understood that the spring 43 is selected to have a strength sufficient to overcome an expected friction at the flange 33 and sufficient to maintain in the system an above ambient minimal pressure which, as reflected in chamber 42, keeps the diaphragm 41 in a proper convolution and prevents it from displacing through clearance 39 into the chamber 42. When the system is restarted, therefore, the diaphragm is found in its normal, convoluted position and no pressures are applied damaging to the diaphragm.

The invention has been disclosed with respect to particular embodiments. Structural modifications have been discussed and these and others obvious to a person skilled in the art to which this invention relates are considered to be within the intent and scope of the invention.

What is claimed is:

1. In a substantially closed fluid circulating system, a pump which when in operation circulates fluid under pressure, said pump having inlet and outlet sides having regard to the direction of flow of fluid therethrough, said inlet and outlet sides representing respectively suction and pressure sides of the pump, an accumulator-reservoir device of the bootstrap type, a connection from said device to apply a fluid pressure to the suction side of said pump, a connection to said device from the pressure side of said pump to generate in said device during operation of said pump the fluid pressure applied to the suction side of said pump and to maintain fluid pressure in the system during operation of the pump, said device including a housing and a sliding piston in said housing in frictional contact with an interior wall thereof, oppositely directed portions of said piston being exposed to communicate with said system respectively at the suction side of said pump and at the pressure side thereof, and a spring independent of said pump in said housing and acting on the said piston portion exposed to communicate with said system at the pressure side of said pump to maintain at least a minimal above ambient fluid pressure in said system while said pump is not operating, said spring having a force sufficient to overcome frictional resistance to movement of said piston during nonoperating conditions of said pump but which force does not significantly affect movements of the piston in an operational mode of the system during which the pump is operating.

2. A system according to claim 1, said device further including a rolling diaphragm interconnecting said piston and said housing and defining to one side thereof and with said piston portion a chamber in said housing communicating with the fluid system at the pressure side of said pump, said spring being received in said chamber based on said housing and bearing on said piston portion.

3. A system according to claim 2, said housing defining with said diaphragm to the other side thereof a chamber communicating with ambient surroundings, said piston having a body to which said diaphragm is connected and exposed along with said diaphragm to the other side thereof to the pressure of ambient surroundings.

4. A system according to claim 3, said piston body being reduced in cross section relative to said piston portion and extending therefrom in a substantially concentric spaced relation to an interior wall of said housing to define thereby an annular space forming said chamber communicating with the fluid system at the pressure side of said pump, the interior wall of said housing providing a shoulder in an opposing longitudinally spaced relation to said piston portion, said spring being a helical coil spring received in said annular space to have one end based on said shoulder and an opposite end bear on said piston portion.

5. A system according to claim 4, the parts being assembled and constructed to provide a clearance between said piston body and said shoulder on the interior wall of said housing, said diaphragm being movable through said clearance in response to reciprocation of said piston, the exposure of said diaphragm to the other side thereof to the pressure of ambient surroundings subjecting said diaphragm to a pressure tending to displace it through said clearance when said pump is not operating and in the presence of a lowering fluid temperature and in the absence of said maintained minimal pressure.

6. In a substantially closed fluid circulating system, a pump which when in operation circulates fluid under pressure, said pump having inlet and outlet sides having regard to the direction of flow of fluid therethrough, said inlet and outlet sides representing respectively suction and pressure sides of the pump, an accumulator-reservoir device of the bootstrap type, a connection from said device to apply a fluid pressure to the suction side of said pump, a connection to said device from the pressure side of said pump to generate in said device during operation of said pump the fluid pressure applied to the suction side of said pump and to maintain fluid pressure in the system during operation of the pump, said accumulator-reservoir device including a housing and a sliding piston in said housing in frictional contact with an interior wall thereof, oppositely directed piston portions being exposed to communicate with the system respectively at the suction side of the pump and at the pressure side thereof, said device further including a rolling diaphragm interconnecting said piston and said housing and defining to one side thereof and with a piston portion a chamber in said housing communicating with the fluid system at the pressure side of said pump, said diaphragm being exposed to the other side thereof to the pressure of ambient surroundings, and a spring received in said chamber based on said housing and bearing on said piston, said spring having a force sufficient to overcome frictional resistance to movement of said piston during non-operating conditions of said pump but which force does not significantly affect movements of the piston in an operational mode of the system during which the pump is operating, the spring force applying a minimal fluid pressure maintaining said diaphragm in a normally extended non-inverted convolution during non-operating conditions of said pump.

* * * * *

UNITED STATES PATENT AND TRADEMARK OFFICE

CERTIFICATE OF CORRECTION

PATENT NO. : 4,376,619

DATED : March 15, 1983

INVENTOR(S) : Frederick W. Haushalter et al.

It is certified that error appears in the above-identified patent and that said Letters Patent is hereby corrected as shown below:

On the title page, inventors should read

-- Frederick W. Haushalter, Kenton;
Thomas J. Lord, Dayton; and
Richmond A. Gooden, Kettering, all of Ohio --.

Signed and Sealed this

*Twenty-fourth* Day of *May 1983*

[SEAL]

*Attest:*

DONALD J. QUIGG

*Attesting Officer* *Acting Commissioner of Patents and Trademarks*